US006379587B1

(12) United States Patent
Chen

(10) Patent No.: US 6,379,587 B1
(45) Date of Patent: Apr. 30, 2002

(54) INHIBITION OF CORROSION IN AQUEOUS SYSTEMS

(75) Inventor: Longchun Chen, Hopewell Township, NJ (US)

(73) Assignee: BetzDearborn Inc., Trevose, PA (US)

( * ) Notice: Subject to any disclaimer, the term of this patent is extended or adjusted under 35 U.S.C. 154(b) by 0 days.

(21) Appl. No.: 09/304,181

(22) Filed: May 3, 1999

(51) Int. Cl.[7] ..... C23F 11/04; C23F 11/14; C08K 5/3472

(52) U.S. Cl. ..... 252/392; 252/180; 252/390; 524/106

(58) Field of Search ..... 252/390, 392, 252/180; 524/106; 422/12, 16

(56) References Cited

U.S. PATENT DOCUMENTS

| | | | | | |
|---|---|---|---|---|---|
| 3,619,347 | A | | 11/1971 | Ireland, Jr. | 162/5 |
| 3,620,667 | A | | 11/1971 | Zimmie | |
| 3,860,464 | A | | 1/1975 | Erdman | 156/7 |
| 3,867,259 | A | | 2/1975 | Forgione | |
| 4,029,577 | A | * | 6/1977 | Godlewski et al. | 252/180 X |
| 4,285,823 | A | * | 8/1981 | Sung et al. | 252/390 X |
| 4,317,744 | A | * | 3/1982 | Levi | 252/390 X |
| 4,517,098 | A | * | 5/1985 | Hann et al. | 252/180 X |
| 4,640,793 | A | * | 2/1987 | Persinski et al. | 252/390 X |
| 4,683,035 | A | | 7/1987 | Hunt et al. | 204/1 T |
| 4,758,312 | A | | 7/1988 | Hunt et al. | 204/1 T |
| 4,978,456 | A | * | 12/1990 | Sprague | 252/180 X |
| 5,096,718 | A | | 3/1992 | Ayres et al. | 426/9 |
| 5,141,675 | A | | 8/1992 | Vanderpool et al. | 252/389.23 |
| 5,240,956 | A | | 8/1993 | Kirschenheuter et al. | 514/419 |
| 5,260,061 | A | | 11/1993 | Ayres et al. | 424/115 |
| 5,314,910 | A | | 5/1994 | Kirschenheuter et al. | 514/443 |
| 5,425,914 | A | | 6/1995 | Brown et al. | 422/16 |
| 5,610,068 | A | | 3/1997 | Stuart et al. | 436/6 |
| 5,635,484 | A | | 6/1997 | Ayres et al. | 514/18 |
| 5,993,852 | A | | 11/1999 | Folvari et al. | 424/450 |
| 6,187,262 | B1 | * | 2/2001 | Cheng et al. | 422/16 |

FOREIGN PATENT DOCUMENTS

| | | | | |
|---|---|---|---|---|
| DE | 4218585 | | 9/1993 | |
| EP | 237738 | | 9/1987 | |
| EP | 0484949 | | 5/1992 | |
| JP | 53-86653 | | 7/1978 | |
| JP | 403163191 | * | 7/1991 | 252/390 |
| WO | 99/11247 | | 3/1999 | |
| WO | 00/11239 | | 3/2000 | |

OTHER PUBLICATIONS

Abo El–Khair et al., "Inhibiting Effect of Triphenyl Tetrazolium Chloride on the Corrosion of Aluminum in HCL", Corrosion Prevention and Control, 1981, pp. 7–10.

Ateya et al., "Inhibition of the Acid Corrosion of Iron with Triphenyl Tetrazolium Chloride", Corrosion Science, vol. 22, No. 8, pp. 717–721, 1982.

Horner et al., Werkstoffe und Korrosion, 29, 654–664 (1978), which includes an English lanuage abstract.

Horner et al., Werkstoffe und Korrosion, 36, 545–553 (1985), which includes an English language abstract.

Mostafa, Corrosion Prevention & Control, vol. 35, No. 3, 1988, pp. 70–72.

El–Khair et al., Corrosion Prevention & Control, vol. 28, No. 4, 1981, pp. 7–10.

Gulil et al., Corrosion Prevention & Control, vol. 34, No. 6, 1987, pp. 149–151 and 159.

Marignier et al., Journal de chimie physique, vol. 85, No. 1, 1988, pp. 21–28.

Abdel–Wahab et al., Asian J. Chem., vol. 5, No. 4, pp. 1084–1090, 1993.

Abstract of DE 4218585 A.

Database WPI Section Ch, Week 197836, Derwent Publications Ltd., London, GB; Class A14, AN 1978–63968A, XP002144274.

Finan, Materials Performance, vol. 19, No. 3, Mar. 1980, pp. 24–29.

Database Compendex 'Online! Engineering Information, Inc., New York, NY, US, Abo El–Khair et al, "Inhibiting Effect of Triphenyl Tetrazolium Chloride on the Corrosion of Aluminum in HCL", Database Accession No. EIX82080004798, XP002144271.

Database Compendex 'Online! Engineering Information, Inc., New York, NY, US, Gulil et al., "Inhibition of Acid Corrosion of Ni With 2,3,5–Triphenyltetrazolium Chloride", Database Accession No. EIX88050068999, XP002144272.

Database Compendex 'Online! Engineering Information, Inc., New York, NY, US, Mostafa, "Mechanism of Corrosion Inhibition of Copper by Triphenyl Tetrazolium Chloride in an Acidic Medium", Database Accession No. EIX89010230891, XP002144273.

* cited by examiner

*Primary Examiner*—Richard D. Lovering
(74) *Attorney, Agent, or Firm*—Steven D. Boyd

(57) ABSTRACT

A method and composition for controlling corrosion of metals, particularly ferrous-based metals in contact with aqueous systems is disclosed, which includes treating industrial waters with a combination of (a) a tetrazolium salt of the general formula:

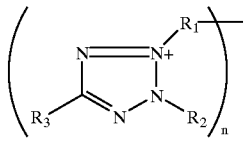

wherein $R_1$, $R_2$ and $R_3$ may be various organic or inorganic substituents, including monomers or oligomers of the above structure, and (b) polyacrylic or polymaleic acid.

2 Claims, No Drawings

INHIBITION OF CORROSION IN AQUEOUS SYSTEMS

FIELD OF THE INVENTION

The present invention relates to the treatment of water to inhibit scale and control corrosion of metals in contact with aqueous systems. More particularly, the present invention relates to the use of tetrazolium salts in combination with polyacrylic acid or polymaleic acid to inhibit scale or prevent corrosion of ferrous-based metals in contact with aqueous systems.

BACKGROUND OF THE INVENTION

In industrial cooling systems, water such as from rivers, lakes, ponds, etc., is employed as the cooling media for heat exchangers. The cooling water from heat exchangers is typically passed through a cooling tower, spray pond or evaporative system prior to discharge or reuse. In these systems, the cooling effect is achieved by evaporating a portion of the water passing through the system. Because of the evaporation which takes place during cooling, dissolved materials in the water become concentrated, making the water more corrosive.

In cooling systems, corrosion causes two basic problems. The first and most obvious is the failure of equipment, resulting in replacement costs and plant downtime. Also, decreased plant efficiency occurs due to the loss of heat transfer. The accumulation of corrosion products causes heat exchanger fouling, resulting in the loss of heat transfer.

Ferrous-based metals, e.g., iron metal and metal alloys containing iron (mild steel), are routinely used in the construction of cooling systems due to their low cost and availability. As the system water passes over or through these ferrous-based metal containing devices, they are subjected to corrosion processes. Corrosion inhibitors are generally added as part of a water treatment program in cooling systems to prevent and inhibit the corrosion of ferrous-based metal containing devices.

Molybdates, zinc, phosphates or polyphosphates, and phosphonates have been used to inhibit the corrosion of ferrous-based metals in contact with the system water of cooling systems. Each treatment, however, presents certain drawbacks.

There exists a need, therefore, for a more environmentally acceptable corrosion inhibitor of ferrous-based metals in contact with aqueous systems.

Preventing the corrosion and scaling of industrial heat transfer equipment is essential to the efficient and economical operation of a cooling water system. Excessive corrosion of metallic surfaces can cause the premature failure of process equipment, necessitating downtime for the replacement or repair of the equipment. Additionally, the buildup of corrosion products on the heat transfer surface reduces efficiency, thereby limiting production or requiring downtime for cleaning.

SUMMARY OF THE INVENTION

The present invention provides an effective method and composition for controlling corrosion of metals, particularly ferrous-based metals in contact with aqueous systems.

The method of the present invention comprises treating industrial waters with a tetrazolium salt of the general formula:

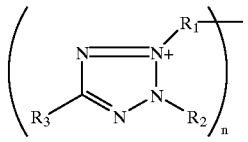

wherein $R_1$, $R_2$ and $R_3$ can be various organic and inorganic substituents, e.g., from the group consisting of lower alkyl, aryl, aralkyl, and heterocyclic substituted aryl with the proviso that neither $R_1$, $R_2$ or $R_3$ contain more than 14 carbon atoms, and n may be 1 or 2, in combination with polyacrylic acid or polymaleic acid.

The tetrazolium compounds may contain positive or negative counter ions in order to balance the charges on the above structure. Chemical or electrochemical reduction of this type of compound produces tetrazolinyls and formazans that readily adsorb on metal surfaces and provide films for corrosion protection.

For example, the tetrazolium compound can be 3,3'-(3,3'-dimethoxy-4,4'-biphenylene)-bis-[2-(p-nitrophenyl)-5-phenyl-2H-tetrazolium chloride] (NBT); 2-(4-iodophenyl)-3-(4-nitrophenyl)-5-phenyl tetrazolium chloride; 2,5-diphenyl-3-(1-naphthyl)-2H-tetrazolium chloride; and 2,3,5-triphenyl-2H-tetrazolium chloride.

In aqueous systems, the following corrosion reactions of metals such as steel occur:

$$Fe \rightarrow Fe^{2+} + 2e^-$$

$$Fe(OH)_2 + OH^- \rightarrow Fe(OH)_3 + e^-$$

When tetrazolium compounds possessing redox potentials higher than that of the corroding metals or alloys are employed, reduction of tetrazolium molecules readily occur on the steel surface to form insoluble materials and, hence, prevent steel from further corrosion.

The invention will now be further described with reference to a number of specific examples which are to be regarded solely as illustrative and not as restricting the scope of the present invention.

DETAILED DESCRIPTION OF THE PREFERRED EMBODIMENTS

The film formation and corrosion inhibition activity of the treatment of the present invention was evaluated with a Beaker Corrosion Test Apparatus (BCTA). The BCTA includes a beaker equipped with an air/$CO_2$ sparge, low carbon steel (LCS) coupon, electrochemical probe and magnetic stirrer. The beaker is immersed in a water bath for temperature control. Electrochemical corrosion data were obtained using linear polarization resistance technique. All tests were conducted at 120° F., 400 RPM for 18 hours.

For all tests, a water consisting of 100 ppm Ca (as $CaCO_3$), 50 ppm Mg (as $CaCO_3$), 100 ppm chloride, and 100 ppm sulfate was used. A pH of 7.6 was utilized with the corresponding "M" alkalinities being 32 ppm as $CaCO_3$. About 5 ppm of a copolymer of acrylic acid and an allylhydroxypropylsulfonate ether sodium salt (AA/AHPSE) was also used.

TABLE 1

| Treatment A | Molecular Weiqht | ppm | Treatment B | ppm | Average Corrosion Rate(mpy) |
|---|---|---|---|---|---|
| PAA | 30,000 | 30 | | | 28.10 |
| PAA | 30,000 | 28 | NBT | 2 | 66.60 |
| PAA | 30,000 | 25 | NBT | 5 | 32.20 |
| PAA | 8,000 | 30 | | | 8.89 |
| PAA | 8,000 | 28 | NBT | 2 | 17.30 |
| PAA | 8,000 | 25 | NBT | 5 | 4.97 |
| PAA | 5,100 | 30 | | | 8.03 |
| PAA | 5,100 | 28 | NBT | 2 | 6.22 |
| PAA | 5,100 | 25 | NBT | 5 | 1.15 |
| PAA | 5,000 | 30 | | | 5.33 |
| PAA | 5,000 | 28 | NBT | 2 | 2.25 |
| PAA | 5,000 | 25 | NBT | 5 | 0.63 |
| PMA | 1,000 | 10 | NBT | 5 | 6.80 |
| PMA | 1,000 | 20 | NBT | 5 | 1.27 |
| PMA | 1,000 | 30 | NBT | 5 | 1.20 |

PAA: Polyacrylic acid
PMA: Polymaleic acid
NBT: Nitro Blue Tetrazolium chloride monohydrate In a preferred embodiment of the present invention, the combination is added to the aqueous system at active treatment levels ranging from about 0.1 to about 50 parts per million, with treatment levels of from about 1 to about 25 parts per million particularly preferred.

Systems capable of benefiting from the treatments of the present invention include cooling water systems, steam generating systems, gas scrubbing systems, and pulping and papermaking systems, such as continuously or intermittently. The pH of the aqueous system to be treated is about 6 or greater.

The molecular weight of the polyacrylic acid or polymaleic acid can be about 8,000 or below.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

I claim:

1. A composition for controlling the corrosion of metals in contact with an aqueous system which comprises a combination of (a) nitro blue tetrazolium salt; and (b) polymaleic acid is polyacrylic acid having a molecular weight about 8,000 or below, wherein the ratio of (a):(b) ranges from 2:1 to 14:1, in a concentration of from about 0.1 ppm to 50 ppm and wherein the corrosion rate for metals in contact with said aqueous system comprising said combination is lower than the corrosion rate for metals in contact with an aqueous system comprising (b).

2. The composition of claim 1 wherein said nitro blue tetrazolium salt is from blue tetrazolium chloride monohydrate.

* * * * *